US006623326B2

(12) United States Patent
Judkins

(10) Patent No.: US 6,623,326 B2
(45) Date of Patent: Sep. 23, 2003

(54) SOUND-EFFECTS GENERATING DEVICE WITH BIPOLAR MAGNETIC SWITCHING FOR ACTIVITY DEVICES

(75) Inventor: Daniel Judkins, Chicago, IL (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/025,073

(22) Filed: Dec. 19, 2001

(65) Prior Publication Data

US 2003/0114072 A1 Jun. 19, 2003

(51) Int. Cl.[7] ..... A63H 30/00
(52) U.S. Cl. ..... 446/175; 446/130
(58) Field of Search ..... 446/175, 130, 446/131, 134

(56) References Cited

U.S. PATENT DOCUMENTS

| | | | |
|---|---|---|---|
| 3,232,004 A | | 2/1966 | Felsher |
| 3,569,928 A | | 3/1971 | Avallone |
| 3,781,845 A | | 12/1973 | Ellul |
| 3,984,658 A | | 10/1976 | Cannon |
| 4,214,402 A | * | 7/1980 | Ogawa |
| 4,326,124 A | | 4/1982 | Faude |
| 4,333,258 A | | 6/1982 | McCaslin |
| 4,349,814 A | | 9/1982 | Akehurst |
| 4,737,131 A | | 4/1988 | Sirota |
| 5,130,693 A | | 7/1992 | Gigandet |
| 5,277,643 A | | 1/1994 | Ejima |
| 5,295,889 A | | 3/1994 | Ejima |
| 5,349,129 A | | 9/1994 | Wisniewski et al. |
| 5,534,849 A | | 7/1996 | McDonald et al. |
| 5,603,652 A | | 2/1997 | Rothschild et al. |
| RE35,556 E | | 7/1997 | Weinreich |
| 5,975,979 A | | 11/1999 | Ferri Llorens |
| 6,215,978 B1 | | 4/2001 | Ruzic et al. |

FOREIGN PATENT DOCUMENTS

| | | |
|---|---|---|
| DE | 22 11 468 | 9/1973 |
| GB | 2 196 545 | 5/1988 |

* cited by examiner

*Primary Examiner*—Derris H. Banks
*Assistant Examiner*—Ali Abdelwahed
(74) *Attorney, Agent, or Firm*—Michael Best & Friedrich, LLC

(57) ABSTRACT

A sound producing unit and a light emitting unit are provided in the toy body so as to be actuated when combined proximally with another toy body. A battery-powered, electro-mechanical device includes a bipolar magnet, which automatically generates sound-effects and flashing lights depending on its position. The stimulus may include at least one of a sound producing unit or a flashing light emitting unit arranged in at least one of the proximally located combined toy vehicle bodies. The device includes an actuator/sensor, an electronic circuit board, a sound-effects generator, an amplifier, a speaker, LED lamps and driver. Combinable toy vehicles and the like include toy vehicle bodies such as battling starships with at least one detachably combined toy adapted to actuate a stimulus appealing to the sense such as at least one of a sound producing unit and a light emitting unit arranged in at least one of the toys and the proximally located combined toy.

10 Claims, 3 Drawing Sheets

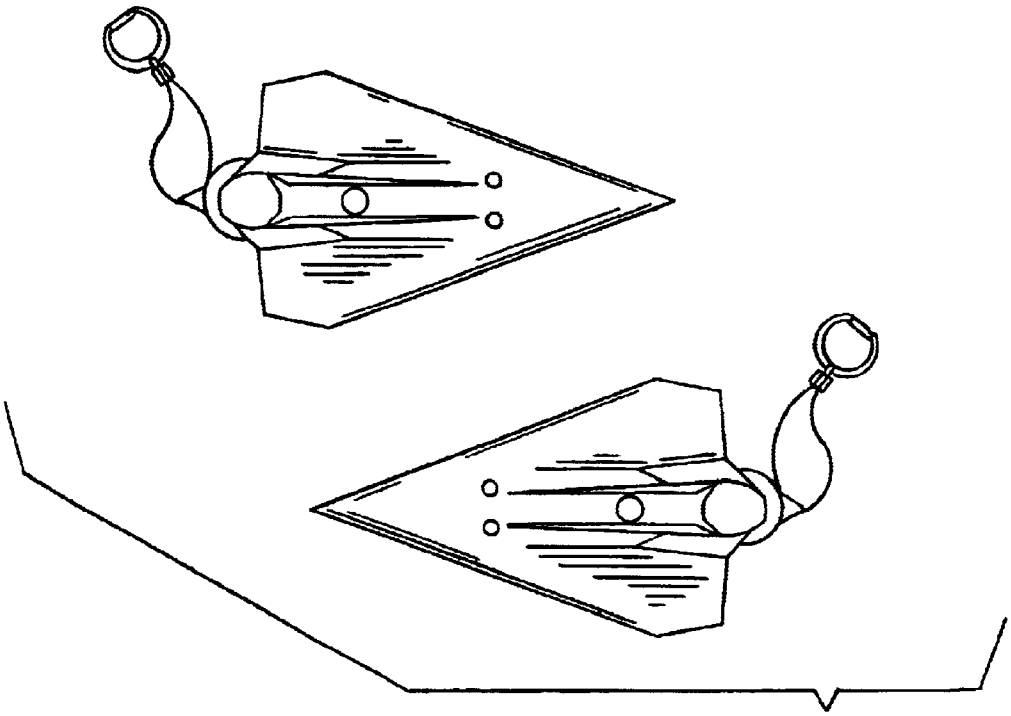
FIG. 3B
FIG. 3A
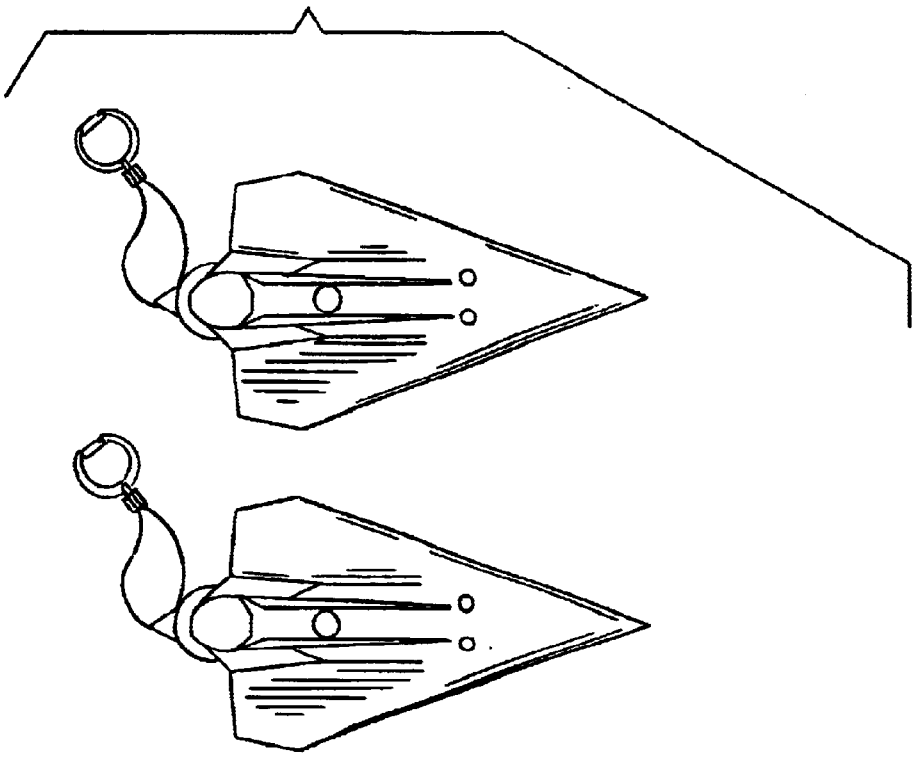

SOUND-EFFECTS GENERATING DEVICE WITH BIPOLAR MAGNETIC SWITCHING FOR ACTIVITY DEVICES

BACKGROUND OF THE INVENTION

1. Field of the Invention

The present invention relates to electro-mechanical devices for generating sound-effects and light emitting device (LED) illumination responsive to a change in position or proximity as between two or more such devices, and more particularly relates to such devices being incorporated with toys and novelties whose location changes with use during game play. Combinable toy vehicles and the like include toy vehicle bodies such as battling starships with at least one other proximally combined toy vehicle body adapted to actuate a stimulus producing mechanism in at least one of the toy vehicle bodies for producing at least one predetermined is stimulus appealing to the players.

2. Description of the Related Art

Conventional combinable toys generally include a toy body and a plurality of attachments or a trigger device such as an encapsulated magnet to trigger pre-established stimulus. Some combinable sound generating toys such as dolls and vehicles make pre-established identifiably sounds when they are tipped. Many toys or devices require some form of manual intervention to generate particular or situation-appropriate tones, voices, or other sound-effects. Most of the modern electronic devices can generate sophisticated tones and sound-effects such as machine-gun fire, laser cannon, phaser, death-ray, and the like, with selector switches set previously to output the desired sound-effects, usually requiring different buttons to be pushed manually to select the various sounds-effects used by players in accordance with interaction with good or bad counterparts based on the game play.

Thus, it is apparent that there is a need for a device which can automatically generate different sound-effects and flashing lights with a change in position of said device when such device is mounted so as to be proximally located or combined with another vehicle or toy controlled by the action of the players.

SUMMARY OF THE INVENTION

It is therefore one object of this invention to provide a battery-powered, electro-mechanical device which can automatically generate situation-specific sound-effects with a change in position proximal combination or movements with respect to other such devices detecting the appropriate stimulus magnetically without requiring buttons to be pressed, or switches to be manually selected.

It is yet a further object of the invention to provide a sound-effect and flashing LED illumination generating device which can be safely and securely mounted within or about a toy enclosure or moving vehicle which is environmentally safe. The stimulus producing mechanism includes bipolar magnetic switching means. The stimulus may include at least one of a sound producing unit or a flashing light emitting unit arranged in at least one of the proximally located combined toy vehicle bodies. The objectives of this invention are achieved as follows. The electro-mechanical device is designed to automatically generate sound-effects and flashing lights when its position is changed, tilted, etc. The battery-powered device is housed to include a combined actuator/sensor for detecting states of the device whereby the detected states produce distinct electronic signals which are routed through an electronic circuit board to the inputs of a sound-effect generator programmed to assign from its internal memory of pre-programmed sound-effects, a different sound-effect or tone combination relative to each positional state detected. Waveform outputs generated by the programmed sound-effect generator drive an audio amplifier/loudspeaker and a LED lamp driver so that the effects are made audible and visible.

The actuator/sensor housed in the device provides a sound-effects generating device with bipolar magnetic switching for activity devices utilizing reed switches actuated by individual poles of permanent or electrical magnets. The sensed output signal from the actuator/sensor may be directed directly to the inputs of the sound-effect generator or appropriately interfaced by means of electronic circuitry. The actuator/sensor is preferably self-contained. The sound-effects generator may be designed with a built-in timer which is programmed to sequence or rotate the sound-effects from their assigned positions to adjacent or new positions based upon a predetermined time interval. Multiple good and bad sound and illumination effects are thereby generated such that good effects are automatically produced by like devices being proximal to one another, while bad effects are the product of a good device being proximally combined with a bad or evil device such as an enemy starship.

The sound-effects generator is also programmed to produce more sound-effects or tones than the actual number of positions it can detect, and after a predetermined time interval a rotating sound pattern shifts out the sound-effect assigned relative to a particular position and introduces a new sound-effect relative to that position. The number of sound-effects generated is limited only by the size of the memory within the sound-effects generator before the whole cycle is repeated.

A timer switch position can also be sensed by an input to the sound-effects generator which is programmed to command the action of the built-in timer to freeze the rotating sound pattern when the switch is OFF, while allowing the resumption of the rotating sound pattern when the switch is back in the ON position. LEDs are positioned on the outer perimeter of the encasement which are activated to flash or blink at fixed or varying duty cycles and rates, by the sound-effects generator through an LED driver.

In order to easily change batteries and facilitate the servicing of the device, battery compartments are positioned within and around the perimeter walls of the encasement with door openings in the rear.

In a preferred embodiment of the invention, the battery-powered, electro-mechanical device is housed in a rigid encasement and automatically generates sound-effects and flashing lights by employing a sealed actuator/sensor having a non-metallic body, with the bipolar magnetic elements of the actuator/sensor element being the north and south poles of a magnetic element which can-be switched between two switch states under the influence of either of two external magnetic fields having opposite (N/S) polarity. The actuator/sensor mechanism includes a reed switch positioned to detect the position of the magnet associated with the actuator/sensor when it is positioned relative to a field associated with a pole (N/S) of the magnet of another such device. This is accomplished by the magnetic influence of the magnet on the switches which produces distinct electronic signals routed to the inputs of a sound-effect generator programmed to assign from its internal memory of pre-programmed sound-effects, a different sound-effect or tone combination relative to the combination detected. The waveform outputs generated by the programmed sound-effects generator drive an audio amplifier/loudspeaker and, an LED lamp driver in order to make the generated effects audible and visible.

The sound-effects generating device with bipolar magnetic switching for activity devices disclosed will be better understood and further objects and advantages thereof will become more apparent from the detailed description of a preferred embodiment, taken in conjunction with the drawings.

BRIEF DESCRIPTION OF THE DRAWINGS

A further understanding of this invention is presented by reference to the following detailed description read in conjunction with the accompanying drawings, wherein:

FIGS. 3A and 3B show game play employing, e.g., two "good" toy vehicles and two "opposing" toy vehicles, respectively, so as to be actuated when combined proximally with one another.

DETAILED DESCRIPTION OF THE PREFERRED EMBODIMENT

A combinable toy device according to the present invention will be described hereinafter with reference to the accompanying drawings. Combinable toy vehicles and the like include toy vehicle bodies such as battling starships with at least one detachably combined toy adapted to actuate a stimulus producing means for producing at least one predetermined stimulus appealing to the sense such as at least one of a sound producing unit and a light emitting unit arranged in at least one of the toys and the proximally located combined toy. The stimulus producing mechanism includes bipolar magnetic switching means. The stimulus may include at least one of a sound producing unit or a flashing light emitting unit arranged in at least one of the proximally located combined toy vehicle bodies.

Figure 1:
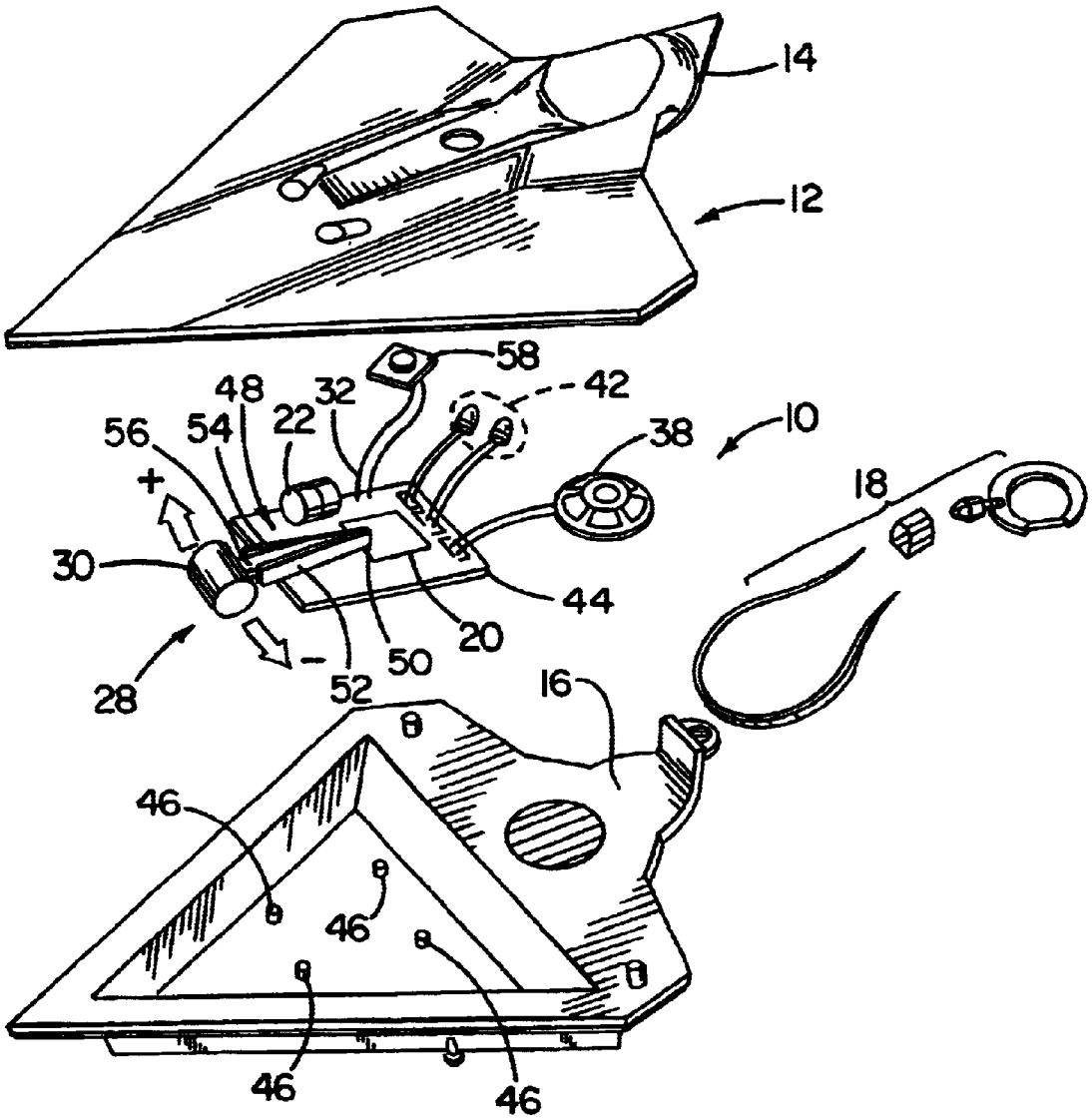
FIG. 1 is a block diagram of a general aspect of an embodiment of the electro-mechanical device of this invention illustrating an enlarged top view of one embodiment of the electronic circuit board layout showing its main components.
Figure 2:
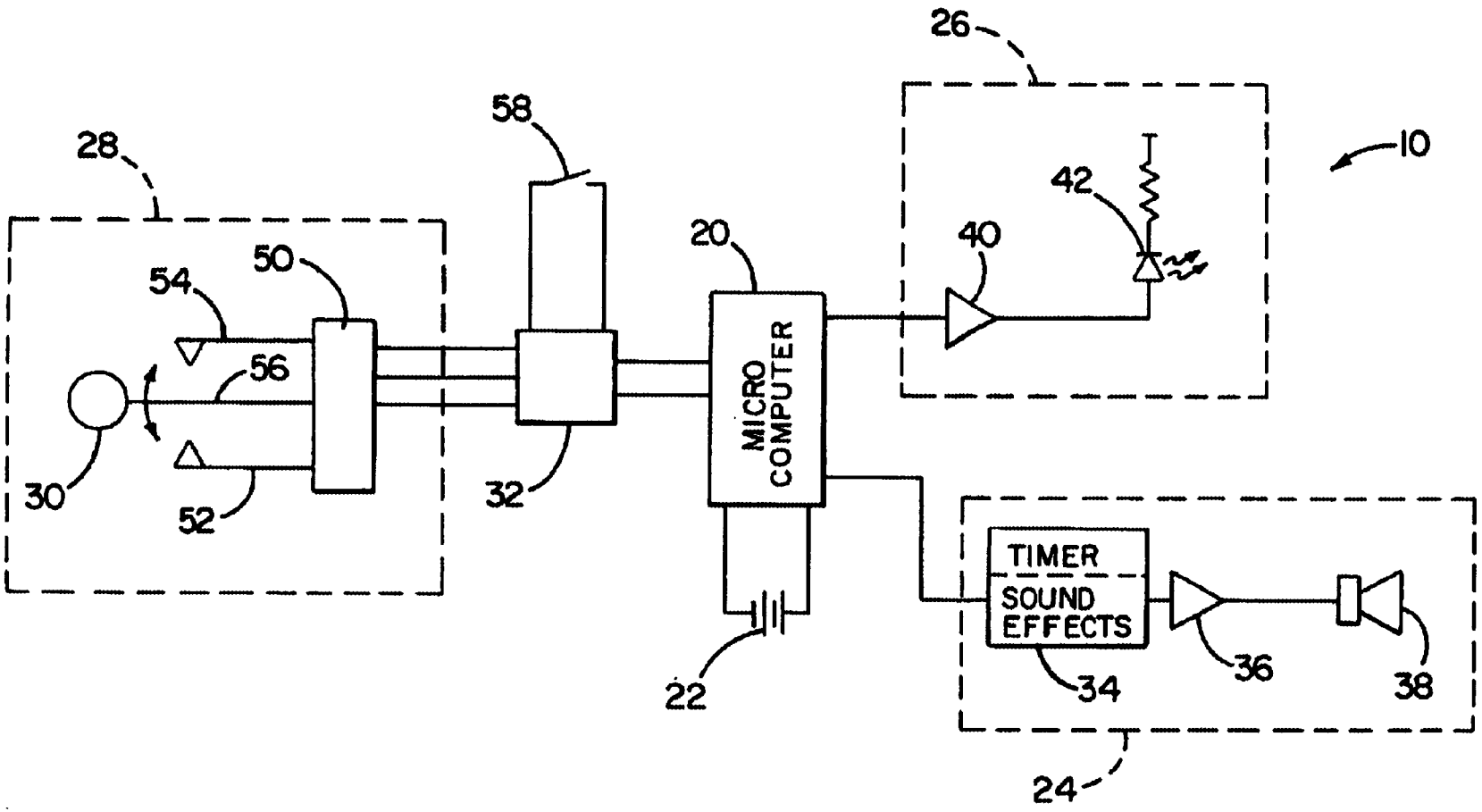
FIG. 2 is a simplified schematic of the electronic circuitry of the device in accordance with this invention.

Referring first to FIGS. 1 and 2, an embodiment of a combined toy according to the present invention is shown, in which a combined toy device is generally designated at reference numeral 10. The combined toy may be constructed so as to exhibit a configuration in imitation of any actual thing when it is assembled. In the illustrated embodiment, it is constructed as a starship fighter configuration when assembled. The combined toy device 10 generally includes a fuselage constituting a toy vehicle body 12, a top portion 14, a bottom portion 16, and an attachment 18 which constitute lanyard, key chain or belt clip-on attachments that may be detachably combined with or connected to the toy body 12.

Referring to FIG. 2, a simplified schematic of the electronic circuitry is shown to provide major components or functional assemblies installed within the housing of the device 10 with an open area (FIG. 1) to allow the mounting of the components and sub-assemblies as illustrated. The toy body 12 houses a microcomputer 20, a replaceable battery power source 22 for a power supply, and a stimulus producing means for producing at least one predetermined stimulus appealing to the sense in a manner to be positioned at a central area of the body 12. In the illustrated embodiment, the stimulus producing means includes a sound producing unit 24 comprising a sound synthesizing IC and a light emitting unit 26.

The electro-mechanical device includes an actuator/ sensor assembly 28 which includes a bipolar magnet 30 for detecting the position and/or state of the device. An input signal at 32 is produced in accordance with detected state directed to provide an input to a sound-effects generator 34 which is programmed to assign and generate a different sound-effect or signature tone combination relative to each position or tilt state detected. An audio amplifier 36, a loudspeaker 38, an LED driver circuit 40 with LEDs 42, together with the power source 22 complete the functional componentry of the device 10.

The electronic circuit board 44 is installed in the toy body 12 and shock-mounted on several mounting posts 46. The actuator/sensor assembly 28 includes a reed switch 48 positioned on the circuit board 44 in a predetermined location, such that once the circuit board 44 is installed, the reed switch 48 is located to cooperate with the actuator/ sensor 28. This physical alignment of the reed switch 48 permits sensing of position and perhaps tilt of the device 10 by means of the action of magnet 30 on the reed switch 48. A connector assembly 50 provides the means of connecting the conductor elements 52 and 54 as well as the electrically conductive member 56 to the circuit board 44.

The combinable special effects functional components of device 10 thus comprise the housing toy body 12 with at least one bipolar magnet 30 for a polarized magnetic force field proximally combinable with the body 12. The actuator/ sensor assembly 28 within the body 12 uses the bipolar magnet 30 with a pair of conductive elements 52, 54 sandwiching the bipolar magnet 30 and an electrically conductive member 56 attracted by way of the polarized magnetic force field to adhere to one of the conductive elements 52, 54 with dependence upon the polarized magnetic force field of the magnet assembly. The stimulus producing transducer, e.g., generator 34, produces at least one predetermined audible or visual stimulus (e.g., LED 42). The circuitry for interconnecting the actuator/sensor assembly 28 and the stimulus producing generator 34 facilitates the connection of the electrically conductive member 56 with conductive elements 52 or 54 to activate the stimulus producing generator 34, such that the stimulus producing mechanism is achieved through the use of bipolar magnetic switching means generally wherein the stimulus may include at least one of a sound producing unit (24) or an LED (42) arranged in at least one of the proximally located combined toy vehicle body 12. An alternate push button switch 58 may also be provided for establishing an input activation signal.

The magnet assembly in the housing permits the sound producing unit to produce a sound indicative of the magnet assembly with dependence upon the particular N/S polarization of the magnetic force field. The housing comprises an imitation of a toy vehicle with the magnet assembly being provided within another toy vehicle.

The various sound-effects produced are typically those of machine guns, sirens, laser cannons, phasers, death-rays, bombs and other sounds as well as multiple-tone melody sounds similar to those produced in electronic games. The sound-effects are a direct result of the reed switch 48 input detected by the microcontroller chip.

A custom chip may be used to introduce more sounds than there are positions sensed by the inputs. This is also accomplished using the timer interval, whereupon the microcontroller not only shifts the sound pattern by shifting the look-up table, but also extends the look-up table. For example, as the sound pattern rotates around the positions, the first sound would be dropped instead of shifting it into the last position, and a new sound could be introduced into that position. The number of sounds is limited only by the size of the memory in the microcontroller, which determines the limit of the look-up table and the pre-programmed sounds. At the end of its cycle of sounds, the pointer in the look-up table is reset to the start of the table and the first sound will be reintroduced and the whole cycle repeated. This action again can be locked or un-locked by means of the timer switch.

The interactive star fighters will feature sound effects and flashing LEDs (lasers) and a clip-on to allow them to function as key chains. Six seconds of digital sound effects will be taken, e.g., from a movie, including laser cannon sounds, as discussed above. The addition of the bipolar magnet of actuator/sensor 28 of each star fighter will give added play capabilities as the ships will be able to interact with each other. When contact is established with a second ship, a unique sound effect or phrase will be released from each vehicle. With reference to FIGS. 3A and 3B respectively, the game play employs two (2) "good" craft and two (2) "opposing" space craft. The magnetic polarities detect whether the other craft is friend or foe. Thus, by placing one craft next to another, the magnet will trigger a reaction based on whether the other craft is an opposing craft or not. If it is an opposing craft, LEDs will flash and laser cannon sound effects will play. If it is a friendly craft, speech will be played simulating communication between the two crafts. The star fighters will feature simple one button controls to allow the player to hear the signature phrases and sound effects. Each starship may have up to fifteen (15) seconds of sound effects.

The arrangement of reed switches allows for use of the actuator magnet by the magnetic influence on the reed switches. Movements of the actuator magnet by maneuvers of the user are not the only means of altering its position. Other techniques of producing the same results well known to the art may be utilized. The polarity of the actuator contact or signal may be provided so that the microcontroller can differentiate between normally open and closed contacts or, the polarity of the input signal. Other types of actuator and sensor devices and techniques may be utilized, among these: mercury or electrolytic tilt switches, optical, capacitive or inductive proximity sensors and mechanical contacts. Additionally there are pressure-sensitive piezo-electric film or conductive rubber contacts. All of these devices, together with appropriate interfacing to the microcontroller, can produce the same result.

The foregoing relates to a preferred exemplary embodiment of the sound-effects generating device with bipolar magnetic switching for activity devices, it being understood that other embodiments and variations thereof are possible within the spirit and scope of the invention, the latter being defined by the appended claims.

What is claimed is:

1. A combinable special effects unit comprising:

a housing;

at least one magnet assembly comprising a polarized magnetic force field proximally combined with said housing;

an actuator/sensor assembly within said housing comprising a bipolar magnet, a pair of conductive elements sandwiching the bipolar magnet, and an electrically conductive member attracted by way of the polarized magnetic force field to adhere to one of the conductive elements with dependence upon the polarized magnetic force field of the magnet assembly;

a stimulus producing transducer for producing at least one predetermined audible or visual stimulus; and a circuit for interconnecting the actuator/sensor assembly and the stimulus producing transducer such that the polarized magnetic force field of the magnet assembly proximally combined with said housing relative to the actuator/sensor assembly will activate the stimulus producing transducer, wherein the stimulus emanates from at least one of an audible unit or a visual unit coupled with said housing.

2. A special effects unit as recited in claim 1, wherein said stimulus producing transducer comprises at least one of a sound producing unit and a light emitting unit.

3. A special effects unit as recited in claim 2, wherein the polarized magnetic force field of said magnet assembly comprises a particular N/S polarization, and wherein combination of said magnet assembly with said housing permits said sound producing unit to produce a sound indicative of said magnet assembly with dependence upon the polarized magnetic force field.

4. A special effects unit as recited in claim 1, wherein said housing comprises an imitation of a toy vehicle, said magnet assembly being provided within another toy vehicle.

5. A special effects unit as recited in claim 4, comprising a plurality of magnet assemblies proximally combinable with said housing.

6. A combinable special effects unit as recited in claim 1, comprising a timer associated with a sound-effects generator for controlling a rotating sound pattern.

7. A combinable special effects unit as recited in claim 2, wherein said stimulus producing transducer comprises LEDs positioned on said housing, activated to flash at fixed or variable duty cycles relative to said magnet assembly proximally combinable with said housing.

8. A combinable special effects unit as recited in claim 7, wherein said magnet assembly is mounted on or incorporated into a moving object or vehicle.

9. A combinable special effects unit as recited in claim 8, wherein the object or vehicle comprises a toy star fighter.

10. A combinable special effects unit as recited in claim 6, wherein said sound-effects generator generates electronically generated sirens, laser cannons, phasers, and other sounds including signature phrases.

* * * * *